United States Patent [19]

Cook, Jr.

[11] Patent Number: 4,699,537

[45] Date of Patent: Oct. 13, 1987

[54] DRY POWDER DISPENSER WITH WHEELED TRANSPORT COVER

[75] Inventor: Floyd L. Cook, Jr., Muskegon Heights, Mich.

[73] Assignee: Cooper Clarke, Inc., Clayton, Mo.

[21] Appl. No.: 789,917

[22] Filed: Oct. 18, 1985

Related U.S. Application Data

[63] Continuation of Ser. No. 608,016, May 7, 1984, abandoned.

[51] Int. Cl.[4] ..... B05C 17/02; B05C 19/00

[52] U.S. Cl. ..... 401/131; 401/208; 401/220

[58] Field of Search ..... 401/48, 131, 208, 219, 401/220; 206/45.34; 222/556, 558, 414, 410, 623, 624, 625; 15/49 R, 49 C, 50 R, 41 R, 412

[56] References Cited

U.S. PATENT DOCUMENTS

| | | | |
|---|---|---|---|
| Re. 24,189 | 7/1956 | Peoples | 222/556 X |
| 396,860 | 1/1899 | Coston | 401/220 |
| 632,891 | 9/1899 | Burnett | 401/220 |
| 1,588,838 | 6/1926 | Jones | 222/558 |
| 1,649,941 | 11/1927 | Winsor, Jr. | 222/558 |
| 2,081,673 | 5/1937 | Olson | 401/21 |
| 2,250,692 | 7/1941 | Wise | 401/220 |
| 2,465,117 | 3/1949 | Pierson et al. | 222/625 |
| 2,831,572 | 4/1958 | Messina | 206/45.34 X |
| 3,103,689 | 9/1963 | Borisof | 401/208 X |
| 3,128,015 | 4/1964 | Wallis | 222/624 |
| 3,172,574 | 3/1965 | Hiler et al. | 222/623 X |
| 3,221,938 | 12/1965 | Yonkers et al. | 222/414 X |
| 3,336,627 | 8/1967 | Nemoede et al. | 222/613 X |
| 4,369,539 | 1/1983 | Nordeen | 15/49 C |

FOREIGN PATENT DOCUMENTS

| | | | |
|---|---|---|---|
| 598225 | 6/1934 | Fed. Rep. of Germany | 222/556 |

*Primary Examiner*—Steven A. Bratlie

*Attorney, Agent, or Firm*—Paul M. Denk

[57] ABSTRACT

An apparatus for dispensing essentially dry powder onto a surface to be cleaned such as a carpet. The apparatus comprises a hopper for holding essentially dry powder, a cylindrical applicator, rotatably carried by the hopper and mounted such that one portion of the applicator is in contact with the carpet to be cleaned and the other portion is in communication with the inside of the hopper. A transport cover encloses the applicator when the apparatus is not in use. A hopper cover and sealing means maintains the moisture content of material inside the hopper.

12 Claims, 6 Drawing Figures

DRY POWDER DISPENSER WITH WHEELED TRANSPORT COVER

TECHNICAL FIELD

This invention relates to a dry powder dispensing apparatus. Specifically it relates to an apparatus which is operated manually by a standing operator to deposit dry powder on to a surface to be cleaned, such as a carpet.

BACKGROUND OF THE INVENTION

Rugs and carpets are adaptable to being cleaned utilizing liquid detergent, foams, or dry powders. The dry powder cleaning method is preferred in many instances because there is no need to wait for the carpet to dry before traffic can be resumed and furniture moved back into place.

Cleaning carpets by the dry powder method is conventionally done in three steps. First, the dry powder is dispensed onto the carpet. Second, the powder is impinged into the nap of the carpet by a suitable brush means. Third, the residue is removed from the carpet. This final step of removing the residue can be accomplished by a vacuum cleaner. Although upright vacuum cleaners are generally used, any conventional vacuum cleaner such as a canister vacuum may also be used.

Conventionally, the first two of the three steps for cleaning carpets with a dry powder have been combined in a single apparatus, which dispenses the dry powder onto the carpet and impinges it into the nap of the carpet. U.S. Pat. No. 3,173,165 to Speigt discloses a liquid detergent applicator and a brush scrubbing means for impinging the detergent into the carpet. Speigt discloses the dispensing of a liquid detergent. Due to the differences in chemical adhesion between a liquid and powder, the teachings of Speigt are not adaptable to solving the problem of dispensing a dry powder.

U.S. Pat. No. 2,222,909 to LoCascio discloses an apparatus which is capable of dispensing dry powder onto a carpet and impinging the powder into the nap thereof. The apparatus disclosed therein utilizes a plurality of rotatable brushes mounted so as to contact the surface to be cleaned. One portion of the brush is exposed to a chamber in a hopper containing the dry powder. Powder is force fed to the brushes by a spring assisted piston which exerts a downward force on the powder within the chamber which is in communication with the brushes.

U.S. Pat. No. 3,289,240 to Vanderveer discloses a combination apparatus capable of dispensing dry powder and impinging it into the nap of a carpet. Vanderveer's apparatus comprises feed rollers in contact with both the floor surface and hopper. The hopper contains a plate of shorter length than the hopper which defines two apertures under which the rollers are mounted. The apertures are used as an orifice to determine the volume of dry powder deposited on the brushes thereunder.

U.S. Pat. No. 4,381,157 to Brown also discloses an apparatus capable of dispensing and impinging dry carpet powder. Brown's apparatus is similar to that of Vanderveer and LoCascio but utilizes a removable powder dispenser.

All of the aforementioned apparatus require the use of a conventional vacuum cleaner to remove the residue.

Speight, Locascio and Vanderveer all disclose an apparatus which dispenses and impinges the dry powder in one step. The drawback of combining the two steps, dispensing the powder and impinging it into the carpet, is the loss of effectiveness. The cleaning effectiveness is largely dependent on the degree of impingement of the powder into the nap of the carpet. In apparatus which combine the two steps the impingement is fixed and hence the cleanliness of the carpet cannot be improved substantially with additional impingement without depositing additional dry powder on the surface to be cleaned. This excessive use of dry powder can be very expensive.

The Brown apparatus teaches separating the dispensing and impingement into two separate steps. Impingment of the dry powder with the Brown apparatus is accomplished by lifting the machine from the floor and flipping it over such that the brush portion of the apparatus is in contact with the floor. The brush is then guided manually back and forth over the surface by the operator. The cleanliness of the carpet will be dependent largely on the degree to which the dry powder is worked into the nap of the carpet. Utilizing the Brown apparatus, the operator will have to repeatedly go over the same path.

Conventional apparatus also require that the operator lift the apparatus from the floor so as to carry it to a desired location. With a hopper full or partially full of dry powder, the apparatus can be quite heavy. A more desirable apparatus would be one in which the apparatus would not have to be lifted from the floor and carried. Preferably it could be pushed across the floor. However, if the roller is not covered, some additional dry powder will be deposited on the floor surface while the apparatus is being transported. This makes it necessary for the operator to revacuum some portions of the carpet.

To be effective the powder used as a cleaning agent must be kept fresh—maintained at a certain moisture content. Once the powder drys out it is ineffective as a cleaning agent. The shelf life is a non-sealed container is relatively short—8 hours or less. The hoppers in conventional apparatus are not sealed. Hence, the powder must be removed from the apparatus after each use and stored in sealed container.

SUMMARY OF THE INVENTION

In accordance with the present invention, an apparatus is disclosed for dispensing essentially dry powder onto a surface. The apparatus comprises: a hopper for holding essentially dry powder, an applicator means rotatably carried by the hopper and mounted such that one portion thereof is in contact with the floor surface to be cleaned and another portion thereof is exposed to the dry powder inside the hopper. A transport cover is pivotably carried by the hopper for covering the applicator so as to preserve the moisture content of the dry powder within the hopper when the apparatus is not in use.

The shelf life of conventional dry powders exposed to the drying effect of the atmosphere is about 8 hours. To be effective the moisture content of the dry carpet powder must be maintained at a certain level. Unlike conventional apparatus, the apparatus of this invention is sealed to maintain the moisture content of the dry carpet powder. It has been determined that the dry powder can be left in the apparatus of this invention for a period of up to 7 days while still maintaining the moisture content of the dry powder.

Further, the disclosed apparatus may be transported by the operator to move the apparatus from place to place without having to lift the apparatus from the floor and carry it to a desired location.

The cleaning effectiveness of a dry powder apparatus is largely dependent upon the impingement of the dry powder into the nap of the carpet. Experience has shown that repeated rotary brush action, without the deposit of additional dry powder, can result in improved cleaning effectiveness. However, the conventional designs, which combine the steps of dispensing and impinging into one step, wastefully deposit additional powder when the brush action is repeated. The instant invention eliminates the wasteful deposit of additional powder by separating the two steps. The first step is carried out by the dispensing apparatus of this invention. It has been determined that a separate rotary brush action is a more efficient way to work the dry powder into the nap of the carpet. The type of apparatus which has been found most effective in impinging the powder onto the nap of the carpet is similar to the rotary floor device disclosed in Assignees U.S. Pat. No. 4,542,551 filed Sept. 30, 1983. With a simple change of brush attachments, this type of apparatus is very effective. Additionally, this type of rotary floor apparatus is generally already owned by maintenance personnel. Therefore, it is much more economical and efficient to utilize existing rotary floor apparatus for impinging the powder into the nap of the carpet.

Numerous other advantages and features of the present invention will become readily apparent from the following description of the invention in its various embodiments, from the claims and from the accompanying drawings.

DETAILED DESCRIPTION

Figure 1:
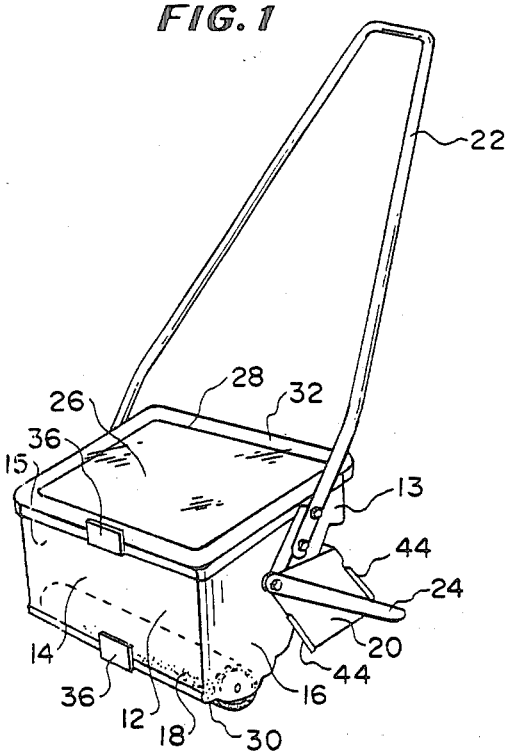
FIG. 1, is a perspective view of a dry powder dispenser in the operating mode in accordance with the present invention.

While this invention is susceptible of embodiment in many different forms, there shown in the drawings, which will herein be described in detail, a preferred embodiment of the invention. It should be understood, however, that the present disclosure is to be considered as an exemplification of the principles of the invention and is not intended to limit the invention to the specific embodiments illustrated.

Referring to the drawings, FIG. 1 illustrates the dry powder applicator apparatus 10 that is the subject of the present invention. The apparatus comprises a container means or hopper 12, an applicator means 18, a transport cover 20, an upper handle 22, a lower handle 24 and a hopper cover 26.

The apparatus 10 is adaptable for use with a variety of dry materials, particularly those which must be dispensed while maintained at a certain moisture content. The Applicant has found the apparatus advantageous in dispensing essentially dry carpet cleaning powder such as that manufactured by Milliken Research Corporation. Normally, this type of powder must be maintained at a certain moisture content. If it is not kept in a sealed container it will dry out and become useless in a matter of hours. The apparatus 10 disclosed herein will keep such a dry powder usable for up to 7 days.

The hopper 12 consists of four sides 13, 14, 15 and 16. When viewed from the top, the cross section of the hopper is generally rectangular. From a side view, such as from sides 15 or 16, the cross section is generally trapezoidal. The hopper 12 illustrated in FIGS. 1 through 5 is but one embodiment. Alternate embodiments may include various geometric shapes, all of which are adaptable for use with the instant invention.

The hopper 12 may be fabricated from sheet metal such as steel, aluminum, tin or from a plastic material. The plastic material is preferable for several reasons. First and most importantly, the dry cleaning powder is rather corrosive to metals. Therefore, either a plastic material is required or the metal must be coated with an anti-corrosive substance. Plastic also has the advantage of being generally lighter than most metallic materials. Further, plastic will not to oxidize or rust. It is also preferable because it will not scratch furniture or other objects when they are inadvertantly bumped while the apparatus is being operated.

The hopper 12 has an upper aperture 28 and a lower discharge aperture 30. The perimeter of the upper aperture is fitted with an upper sealing means 32. The upper sealing means 32 enables a snug fit between a hopper cover 26 and the upper aperture 28, so as to preserve the moisture content of the dry powder in the hopper 12.

The hopper cover 26 fits snugly over the upper aperture 28 and is held secure by the hopper cover handle latch 36. In the embodiment shown in FIG. 1, the hopper cover 26 may be lifted off of the hopper 12 by gripping the hopper cover latch handle 36 and pulling it away from the hopper 12. Several alternate cover embodiments are viable, all of which are in accordance with the instant invention. For example, the hopper cover 26 could be pivotally mounted, such as by pivoting the end opposite the hopper cover handle 36 from the hopper wall 4. Another alternate embodiment would include a cover comprising two portions slidably mounted to expose approximately half of the hopper when the portions are completely overlapping. In still another embodiment the cover 26 would be latched to the hopper 12.

In the preferred embodiment, the hopper cover 26 is made from a rigid transparent material, such as plastic. The transparency of the hopper cover 26 permits visual detection of the amount of dry powder in the hopper 12 at any given time.

Figure 6:
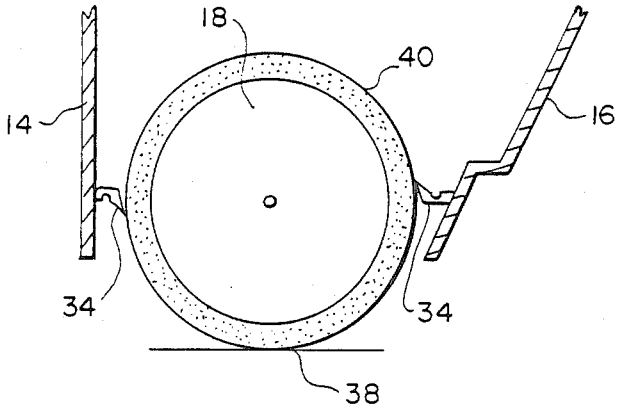
FIG. 6 is a partial sectional view of the dry powder dispenser of FIG. 1.

A lower sealing means 34 is fitted on the edge of the lower discharge aperture 30, so as to define a small gap between the applicator means 18 and the interior edges of sides 13, 14, 15 and 16 of hopper 12. The lower sealing means 34 is used to limit the amount of dry powder deposited on the surface to be cleaned by restricting the gap through which an otherwise unregulated amount of dry powder might flow. In this way the amount of dry powder deposited is controlled almost exclusively by the applicator means 18 (See FIG. 6).

Essentially any organic material can be used for both the upper sealing means 32 and the lower sealing means 34. Materials such as Ethylene propylene rubber, silicone rubber, Buna-N or cork would all be suitable for this purpose. It is preferable that both the upper sealing means 32 and the lower sealing means 34 be secured in place to prevent slippage. Any epoxy is suitable for this purpose. Alternatively, there are sealing materials which do not require epoxy, such as those manufactured by Trim-Lok Corporation. These alternative materials are comprised of a flexible hollow rubber tube which has a gripping clothespin design body.

The applicator means 18 is comprised of a cylindrical roller which generally closes the lower discharge aperture 30. The applicator means 18 is rotatably mounted to the sides 15 and 16 of the hopper 12, such that a first portion or arcuate section 38, located outside of the lower discharge aperture 30, may be placed in contact with the surface to be cleaned. A second portion or arcuate section 40 is separated from the first portion 38 by a lower discharge aperture 30, and is exposed to the dry powder inside hopper 12. The dry powder adheres to the arcuate section 40 which is exposed to the dry powder inside of the hopper 12. As the applicator means 18 is rotated, the dry powder is uniformly deposited on the surface to be cleaned as a portion of the applicator comes into contact with the surface to be cleaned. The application of the dry powder to the surface to be cleaned is continuous as the applicator continues to be rotated either clockwise or counter-clockwise to apply the powder.

In the preferred embodiment a substantial portion of the applicator means 18 is contained inside the hopper 12. This facilitates enclosure of the applicator means 18 by the transport cover 20, and also optimizes regulation of dry powder dispensing.

The width of the applicator means 18 determines the width across which dry powder is deposited. In a typical application, a 16 inch long applicator means is appropriate.

The preferred embodiment of the applicator means 18 is a foam roller of open cell polyester. Various densities of roller foam material may be utilized, so as to either increase or decrease the rate at which dry powder is deposited on the surface to be cleaned. In the preferred embodiment a 2 lb. density foam roller with a pore size of approximately 60 ppi is used. It has been determined through testing that a roller with these parameters optimizes efficiency and powder conservation.

The transport cover 20 is pivotally mounted to the hopper 12. FIG. 1 illustrates the transport cover 20 in a first position, in which it is placed when the dry powder applicator apparatus 10 is being used to spread powder. This defines the "operating mode" of the apparatus. When the transport cover is in this first position, the applicator means 18 is in contact with the surface and is able to perform its desired function. In its first position, the transport cover supports some of the weight of the apparatus 10.

Figure 2:
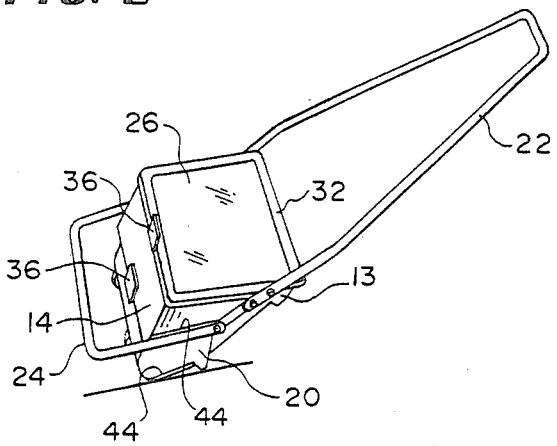
FIG. 2, is a perspective view of the dry powder dispenser of FIG. 1 when configured in its transport mode.

In FIG. 2, the dry powder applicator is shown in a second position, which can be called the "transport mode". In the embodiment shown, the transport cover is rotated approximately 90° between its first and second position. In this second position the transport cover 20 totally encloses the applicator means 18, and the discharge aperture 30 of the hopper 12 so as to maintain the moisture content of the dry powder therein. It also prevents the applicator means 18 from making contact with the surface on which it is resting. This feature allows an operator to transport the powder applicator apparatus 10 quickly, and without having to lift the apparatus free of the surface so as to carry it. Conventional apparatus must be lifted from the surface and carried to avoid dispensing powder during a move to a new location. With a hopper full or partially full of dry powder, the weight of the apparatus can be quite substantial. In the dry powder applicator apparatus 10, the weight of the apparatus is borne by the transport cover 20 when the apparatus needs to be moved from one location to another. Transport cover wheels 42 (see FIG. 3) are rotatably mounted to the transport cover 20 for ease of transport. Almost any conventional wheels are suitable for this purpose. Use of the transport 20 prevents damage to the applicator means when the apparatus is moved over hard or sharp surfaces.

In the preferred embodiment, the transport cover 20 is concave, opening upward relative to the applicator means 18 and spanning the entire length of the applicator means 18. The concave shape permits a contiguous fit of the transport cover 20 to the applicator means 18.

The transport cover 20 may be made from any suitable material such as steel, tin, aluminum, or plastic. In the preferrefd embodiment, plastic is used because of its resistance to corrosion and because its light weight.

A lower handle means 24 has a fixed end and a free end. The fixed end of lower handle means 24 is pivotally mounted to the transport cover 20. As seen from FIGS. 1 through 5, the lower handle means 24 pivots about the same point as the transport cover 20. The lower handle means may be placed in at least two positions. In the first position as illusted in FIGS. 1 and 5, the free end is at a 4:00 O'clock position. This is the operating position. In this position, the lower handle means 34 will not impede operation of the dry powder applicator means 18. FIGS. 2 and 4 illustrate the lower handle means rotated about 90° from the first position to a second position. A lip 44 on the transport cover 20 limits the rotation of the lower handle means 24 and thereby determines its second position. As shown in FIG. 2 the lower handle means 22 is not in contact with the surface when the upper handle 22 is rotated toward the surace, FIG. 2 illustrates the transport mode, in which the lower handle means 24 is basically kept out of the way for ease of transport.

Figure 3:
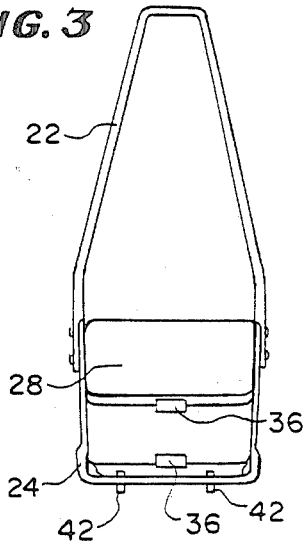
FIG. 3, is a front view of the dry powder dispenser shown in FIG. 1.
Figure 4:
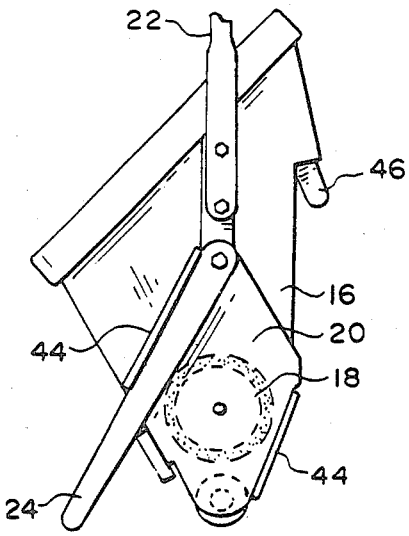
FIG. 4, is a side view of the dry powder dispenser of FIG. 1 when configured in its storage mode.
Figure 5:
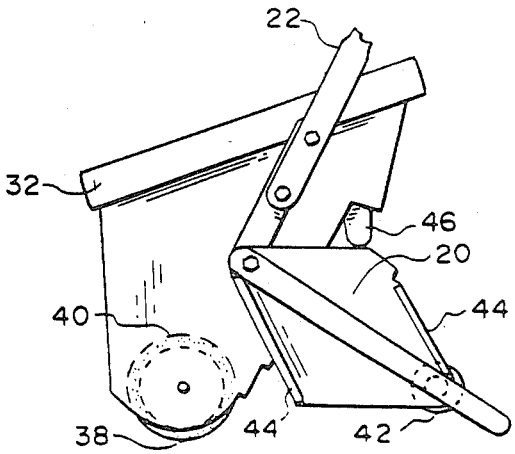
FIG. 5, is a side view of the dry powder dispenser shown in FIG. 1.

FIGS. 3 and 4 illustrate the dry powder applicator apparatus 10 in the storage mode. In this mode the lower handle means 24 is in the same position relative to the dry powder applicator apparatus 10 as in the transport mode. The difference is that in the storage mode, the entire dry powder applicator apparatus 10 is generally upright and the lower handle means 24 serves as a kickstand which makes the apparatus 10 self-supporting. This is illustrated clearly in FIG. 4.

The lower handle means 24 is capable of several embodiments. For example, two separate kickstands could be used, each rotatably mounted to the transport cover 20. In the preferred embodiment as shown, a U-shaped hollow tube is used. However, solid tubes and flat stock are also viable alternatives. The lower handle means can be made of steel, aluminum or plastic. Aluminum is preferable because of its durability and light weight.

The upper handle means 22 is rigidly mounted to sides 15 and 16 of the hopper 12. In the preferred embodiment a hollow U-shaped tube is used. However, any suitable handle means, such as a single rod or bar are feasible. The upper handle means 22, in the preferred embodiment, is made of aluminum.

The operating position of the upper handle 22 can be made adjustable by mounting a threaded screw adjusting boss 46 to side 13 of hopper 12. The threaded screw adjusting boss 46 limits the rotation of the transport cover 20 in the operating mode relative to hopper 12. Adjustment of the threaded screw adjusting boss 46 will change the position of hopper 12 and upper handle 22 relative to the transport cover 20 contact point, thereby changing the position of the upper handle 22.

The dry powder applicator apparatus 10 is readily placed in the operating mode from the storage mode by an operator using one foot to hold the lower handle means 24 to the surface while the upper handle means 22 is tilted toward the floor and forward. This will cause hopper 12 to swing forward and expose the applicator means 18 to the surface. The apparatus 10 is placed in the storage or transport modes by an operator using one foot to hold the lower handle means 24 to the surface while pulling up on the upper handle means 22. This will cause the hopper 12 to swing backwards and join with the transport cover 20 to cover the portion of the applicator means otherwise in contact with the surface to be cleaned.

The dry powder applicator apparatus is particularly adaptable to accomplishing dry carpet cleaning in three steps. First, a dry powder is deposited on the surface to be cleaned. Next, the dry powder is worked into the nap of the carpet. Lastly, the residue is removed. Conventionally two or three of the steps are combined into one machine which must be specifically dedicated to dry carpet cleaning. However, equipment suitable for performing the second and third steps is usually readily available. The duplication of equipment can be quite expensive. The dry powder applicator apparatus 10 makes unnecessary the purchase of redundant equipment. In accordance with the invention, the dry powder applicator apparatus 10 is only used to perform the first step of depositing the powder on the surface. The second step can be accomplished by using an existing rotary floor polisher such as a Clarke Model CC-13 or other Clarke polisher with a 17"/20" dry carpet cleaning scrub brush to work the dry powder into the nap of the carpet. The third step, of removing the residue, can be accomplished with any suitable upright vacuum cleaner such as a Clarke Model 577C or model 512C. With the instant invention overall maintenance equipment costs will be minimized.

Thus, it should be apparent that a unique dry powder applicator apparatus, and a method for dry cleaning a carpet are disclosed. The method and apparatus itself are readily adaptable to conventional design practices and manufacturing techniques. Moreover, while the invention is described in conjunction with specific embodiments, it should be apparent, that there are many alternatives, modifications and variations which will be apparent to those skilled in the art, in light of the foregoing description. Accordingly, it is intended to cover all such alternatives, modifications and variations that fall within the spirit and broad scope of the appended claims.

I claim:

1. An apparatus for dispensing essentially dry powder onto a floor covering comprising:

(a) a hopper for holding the powder, said hopper defining an upper aperture, a lower aperture and an interior space;

(b) a generally cylindrical applicator having a first portion and a second portion, said applicator being rotatably mounted with respect to said hopper such that said first portion of said generally cylindrical applicator may be placed in contact with the floor covering, and said second portion of said generally cylindrical applicator is exposed to said interior space of said hopper;

(c) a transport cover pivotally mounted on said hopper which is adaptable to cover said generally cylindrical applicator so as to prevent said applicator from contacting the floor covering;

(d) means for covering said hopper in a generally airtight manner;

(e) means for rolling said apparatus when said transport cover covers said generally cylindrical applicator.

2. An apparatus for dispensing essentially dry powder onto a floor covering , comprising:

(a) a container means adapted to hold essentially dry powder, said container means defining an upper fill aperture and a lower discharge aperture;

(b) cylindrical applicator means, rotatably mounted with respect to said container means, for dispensing dry powder onto the floor covering said cylindrical applicator means having a first arcuate section and a second arcuate section, said first arcuate section of said cylindrical applicator means being positionable in contact with the floor covering and said second arcuate section being located within said container means, and being in flow communication with said upper fill aperture; and (c) transport cover means for preventing said applicator means from being in contact with the floor covering, said transport cover means being hingedly attached to said container means and pivotally movable between a first position and a second position, said trasnport cover means in said first position generally enclosing said first arcuate section of said cylindrical applicator means, said transport cover means in said second position being disposed at an angle from said first position whereby said first arcuate section of said cylindrical applicator means is exposed such that it may be positioned in contact with the floor covering, said transport cover means further including at least one transport wheel rotatably carried by said transport cover means to facilitate transport of the apparatus.

3. The apparatus as defined in claim 2, further including an upper handle means secured to said container means for guiding said container means over the floor covering.

4. The apparatus as defined in claim 3 wherein the height of said upper handle means is adjustable.

5. The apparatus as defined in claim 2 wherein said transport cover means is generally concave, opening upwardly so as to enclose said cylindrical applicator means in said first position.

6. The apparatus as defined in claim 2 wherein said transport cover means is removably connected to said container means.

7. The apparatus as claimed in claim 2, further including a removal cover means for covering said upper fill aperture of said container.

8. The apparatus as claimed in claim 7, further including a first gasket means which provides a generally air-tight seal between said upper fill aperture of said container means and said removable cover means.

9. The apparatus as defined in claim 8, wherein said lower discharge aperture and said cylindrical applicator means define a gap, said gap further including a second gasket means located within said gap for providing a seal between said lower discharge aperture and said cylindrical applicator means, thereby restricting the flow of essentially dry powder through said lower discharge aperture to the floor covering.

10. The apparatus as defined in claim 7 wherein at least a portion of said cover means is transparent so as to allow visual inspection of the essentially dry powder without removing said cover means.

11. An apparatus for dispensing essentially dry powder onto a floor covering, comprising:

(a) a container means adapted to hold dry powder, said container means defining an upper fill aperture and a lower discharge aperture;

(b) cylindrical applicator means, rotatably mounted with respect to said container means, for dispensing dry powder onto the floor covering , said cylindrical applicator means comprising a first arcuate section and a second arcuate section, said first arcuate section of said cylindrical applicator means being positionable in contact with the floor covering and said second arcuate section being located within said container means, and being in flow communication with said upper fill aperture; and (c) transport cover means for preventing said cylindrical applicator means from being in contact with the floor covering, said transport cover means being hingedly attached to said container means and pivotally movable between a first position and a second position, said transport cover means in said first position generally enclosing said first arcuate section of said cylindrical applicator means, said transport cover means in said second position being disposed at an angle from said first position whereby said first arcuate section of said cylindrical applicator means is exposed such that it may be positioned in contact with the floor covering, said transport cover means further including at least one transport wheel rotatably carried by said transport cover means to facilitate movement of the apparatus;

(d) a removable cover means for covering said upper fill aperture of said container means, said cover means including a gasket means which provides a generally airtight seal between said upper fill aperture of said container means and said removable cover means.

12. The apparatus as defined in claim 11, wherein said removable cover means is pivotally mounted.

* * * * *